US005810351A

United States Patent [19]

Ruckert et al.

[11] Patent Number: 5,810,351

[45] Date of Patent: Sep. 22, 1998

[54] APPARATUS AND METHOD FOR SAMPLE SHEET REMOVAL FROM THE DELIVERY STATION OF A PRINTING PRESS

[75] Inventors: Reinhard Ruckert, Hanau; Peter Hummel, Offenbach am Main; Robert Ortner, Alzenau, all of Germany

[73] Assignee: MAN Roland Druckmaschinen AG, Germany

[21] Appl. No.: 642,152

[22] Filed: May 2, 1996

[30] Foreign Application Priority Data

May 3, 1995 [DE] Germany ..... 195 16 132.7

[51] Int. Cl.[6] ..... B65H 29/00

[52] U.S. Cl. ..... 271/280; 271/211; 271/220

[58] Field of Search ..... 271/207, 211, 271/220, 280; 101/240

[56] References Cited

U.S. PATENT DOCUMENTS

| | | | |
|---|---|---|---|
| 4,205,606 | 6/1980 | Jiruse | 101/240 |
| 4,811,547 | 3/1989 | Raats et al. | 271/211 X |
| 5,179,900 | 1/1993 | Schwitzky | 101/240 |
| 5,607,148 | 3/1997 | Mack et al. | 271/211 X |

FOREIGN PATENT DOCUMENTS

| | | |
|---|---|---|
| 32 30 411 A1 | 6/1983 | Germany . |
| 42 13 032 A1 | 10/1993 | Germany . |

*Primary Examiner*—David H. Bollinger
*Attorney, Agent, or Firm*—Leydig, Voit & Mayer, Ltd.

[57] ABSTRACT

In order to improve the sheet removal at the delivery station of a printing press, a blowing device is provided adjacent a side of a delivery stack of printed sheets. The blowing device includes one or more blowing tubes pneumatically coupled to a sheet hold-up device and two front lays of the printing press at the delivery station. When the sheet hold-up devices are extended into the region of the delivery stack and the front lays are swung to a lowered position, the blowing tubes direct a stream of pressurized air into the region of the front edge of the delivery stack. This pressurized air stream, in turn, produces air cushions above and below the sample sheet which to be drawn out, these air cushions separating the sample sheet from the adjacent printed sheets and permitting air free removal even in the case of large printed formats.

10 Claims, 4 Drawing Sheets

APPARATUS AND METHOD FOR SAMPLE SHEET REMOVAL FROM THE DELIVERY STATION OF A PRINTING PRESS

FIELD OF THE INVENTION

The present invention relates generally to sheet stacking devices in printing presses, and more particularly, to a device for enabling more efficient removal of sample sheets from a stack of sheets at the delivery station of a printing press.

BACKGROUND OF THE INVENTION

In sheet-fed rotary printing machines, printed sheets are delivered onto a delivery stack at the delivery station. In this process, it is necessary, from time to time, to remove a sample sheet from the stack in order to monitor printing quality. For this purpose, it is known to employ an auxiliary device which is moved into the region of the delivery stack for interrupting the stacking process and for enabling a sample sheet located beneath the auxiliary device to be drawn out from the stack. It also is necessary that the auxiliary device and the sheet removal procedure be carried out without damaging or affecting the printing image on the sheet, and this is a particular problem when sheets have large printed areas.

A device of this type for use in sheet-fed printing presses is shown in German patent DE 3 230 436 C2. That device has a secondary gripper for receiving and delivering sheets to the stack at the delivery station. Furthermore, two pneumatic auxiliary devices are provided, and these devices serve to secure a sheet which is to be removed. In this arrangement, a first auxiliary device cooperates with the second auxiliary device, such that it is possible to deposit a sheet on the first auxiliary device, to retain said sheet between the first and second auxiliary devices, and to deposit the following sheets on the second auxiliary device. The secured sheet may then be drawn out from between the auxiliary devices. At the same time, the auxiliary devices blow in air above and below the secured sheet. The device is relatively complicated and has a large number of elements which have to be controlled relative to one another.

OBJECTS AND SUMMARY OF THE INVENTION

It is an object of the present invention to provide a device for more simply and reliably enabling removal of sample sheets from a stack at a delivery station of a printing press.

Another object is to provide a device as characterized above that can be readily incorporated into the delivery station of the printing press.

A further object is to provide a device of the above kind that is adapted for reliable use with sheets having relatively large areas.

Other objects and advantages of the invention will become apparent upon reading the following detailed description and upon reference to the drawings, in which:

Figure 1:
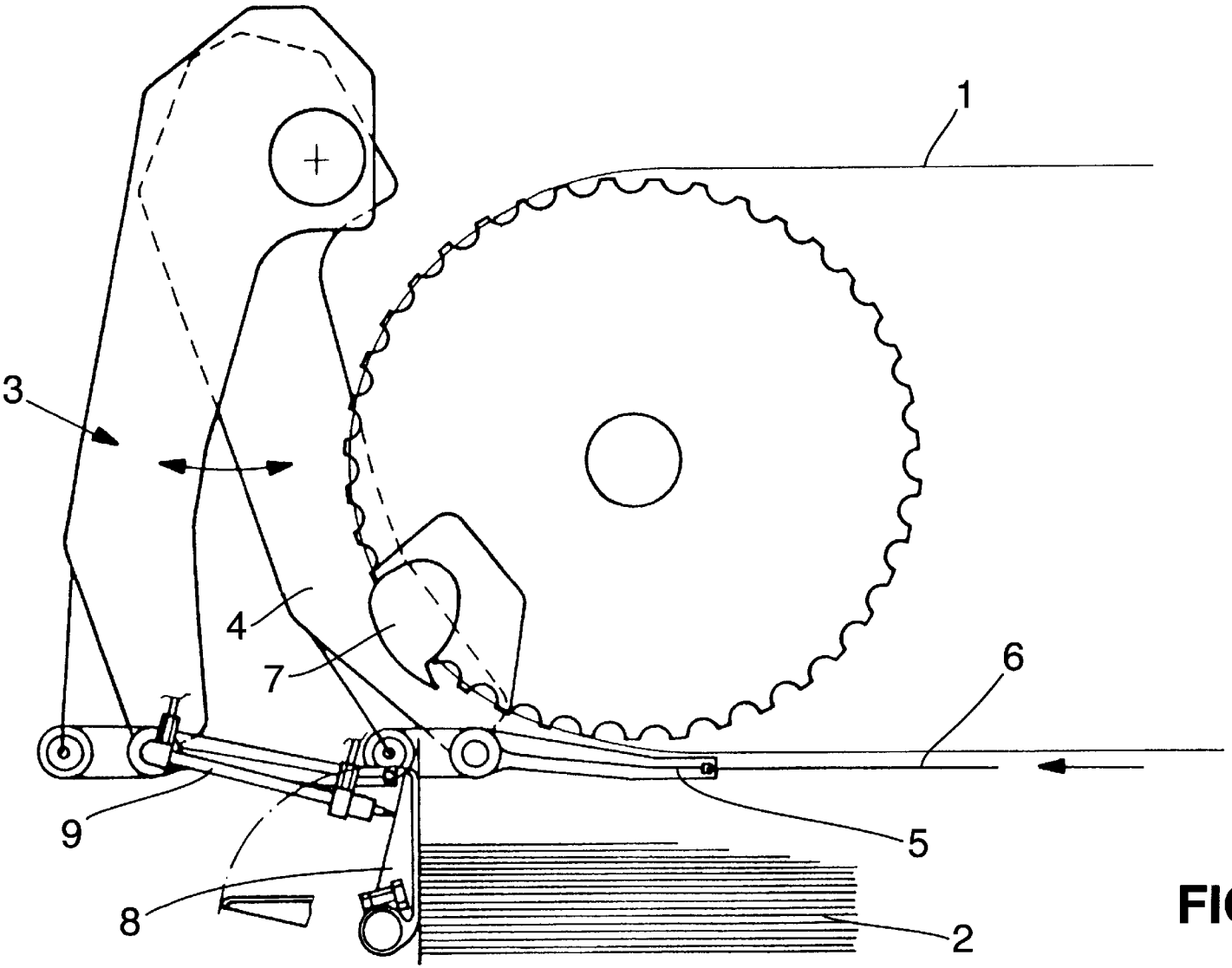
FIG. 1 is a partially diagrammatic side elevational view of a sheet-fed rotary printing press delivery station having a device in accordance with the present invention for reliably enabling removal of sample sheets from a delivery stack.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to FIG. 1 of the drawings, there is shown a delivery station of a sheet-fed rotary printing press. The printing press includes a chain-type sheet conveyor 1 having a plurality of sheet grippers 7 for transferring printed sheets from the printing rollers to the delivery station.

Figure 3:
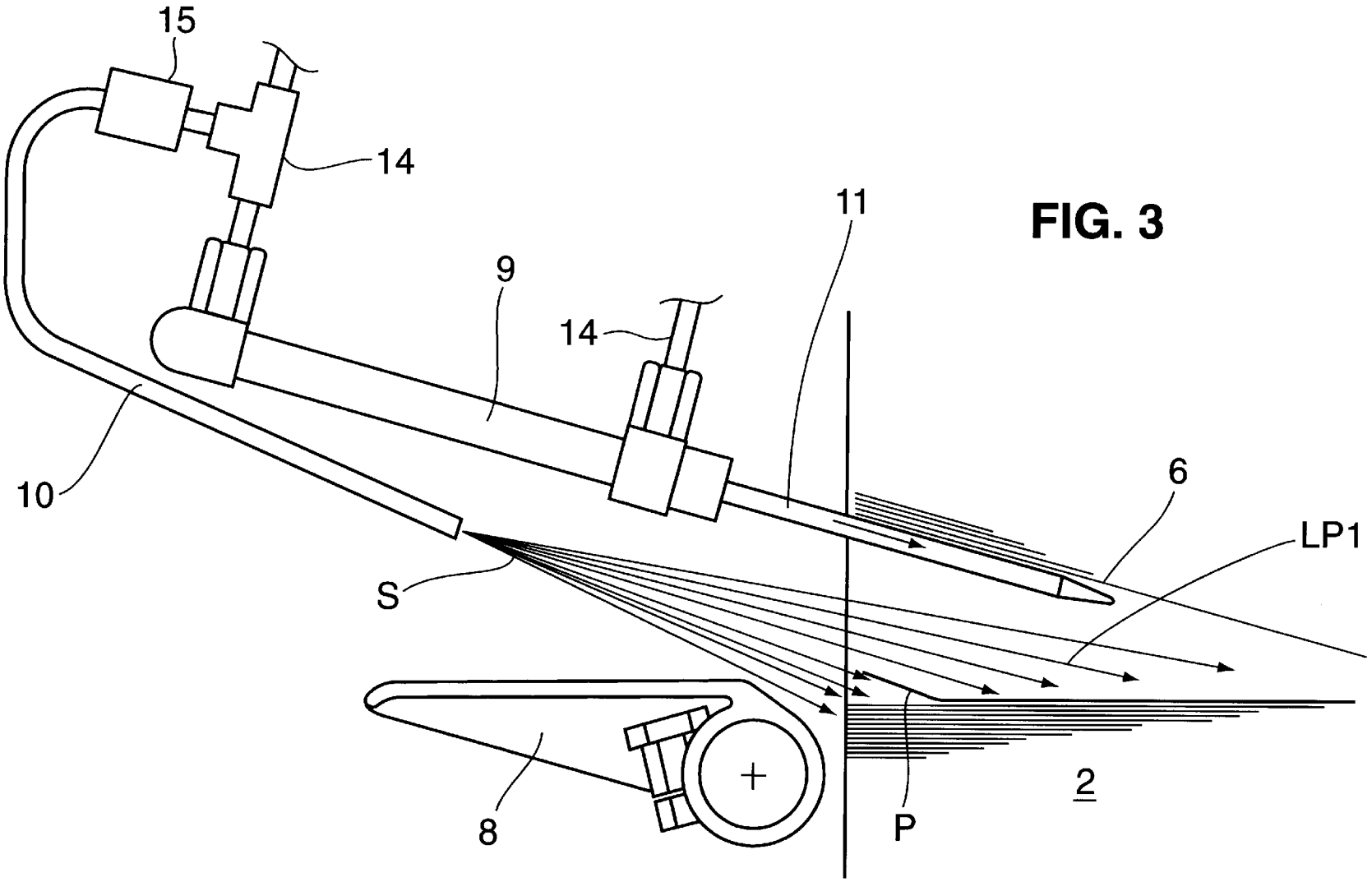
FIG. 3 is a side elevational view, similar to FIG. 2, showing the sheet hold-up device in an extended operating condition at the beginning of a sample sheet removal operation.

For receiving sheets from the sheet conveyor 1 and positioning the sheets on a delivery stack 2 of printed sheets, the delivery station includes a secondary gripper device 3 having a pivotal arm 4 and selectively operable tongs 5 of a conventional type. The tongs 5 of the gripper device 3 are operable for taking printed sheets 6 which are being conveyed by the gripper 7 of the chain conveyor 1 and thereupon depositing the printing sheets 6 on the stack 2 against one or more front lays 8. The front lays, which may be of a conventional type, are pivotable between a vertical, operative position, shown in FIG. 1 against which front edges of the printed sheets are successfully stacked, and a pivoted position away from the stack, as shown in FIG. 3, for enabling removal of sheets from the stack.

Figure 2:
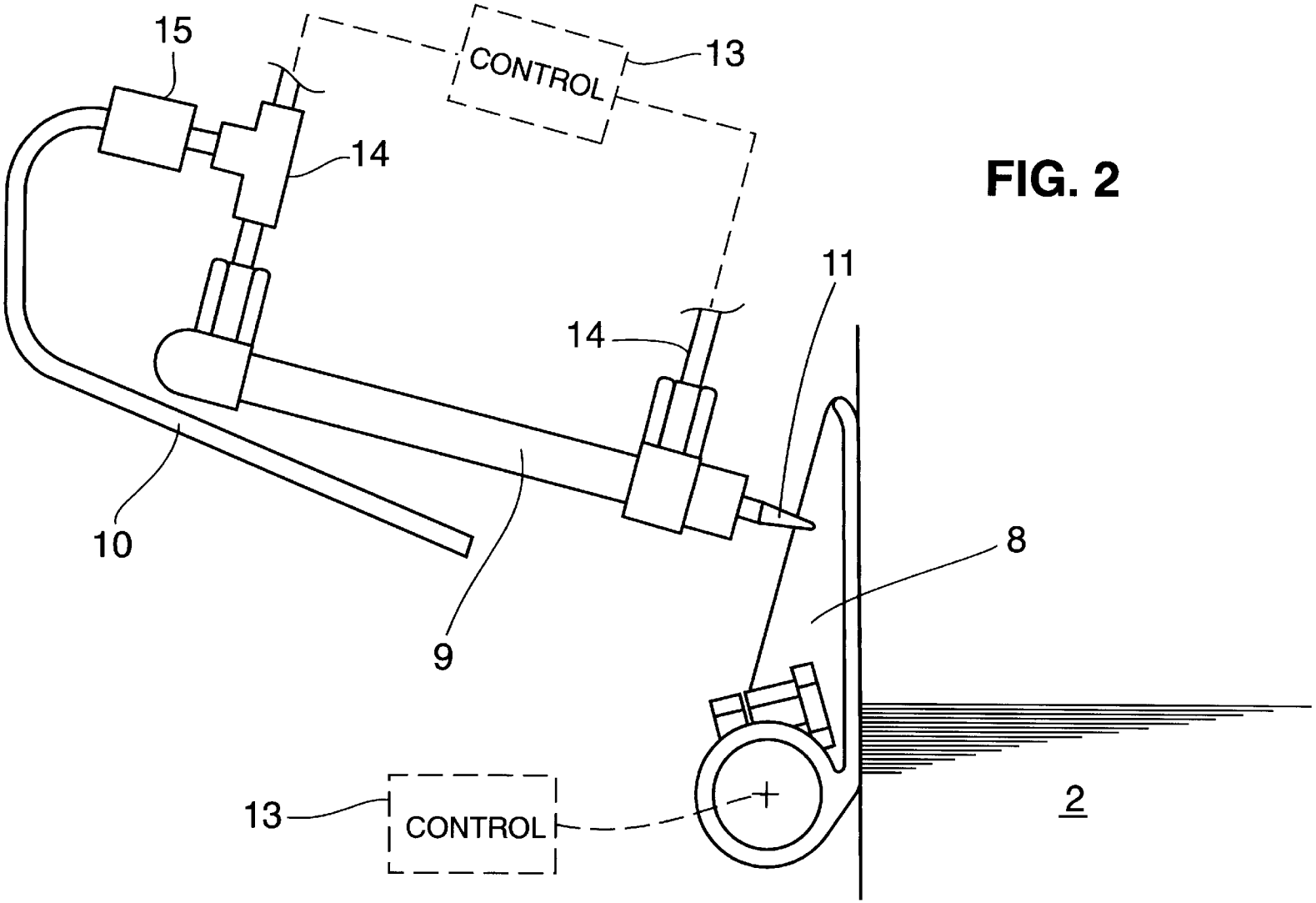
FIG. 2 is an enlarged side elevational depiction of a sheet hold-up device of the illustrated delivery station, showing the sheet hold-up device in a retracted condition during normal operation of the printing press.

To facilitate removal of sample sheets from the stack 2, sheet hold-up devices 9 are arranged in a row adjacent the front lays 8. The sheet hold-up devices 9 may be of a pneumatic cylinder type, which each include a piston rod 11 that is selectively extendable from a retracted position, shown in FIG. 2, to an extended position in the region of the delivery stack, as shown in FIG. 3, by direction of pressurized air through an inlet line 12 under the operation of a suitable control 13. The rods 11 preferably taper to a point at a forward end. When in an extended position, shown in FIG. 2, the sheets are positioned onto an upper side of the piston rod 11 by the gripper, thereby interrupting the stacking operation. Direction of pressurized air through a second inlet line 14 at an opposite end of the device 9 retracts the rod 11 to its original position.

In accordance with the invention, pressurized air directing means are provided adjacent a front edge of the stack of sheets at the delivery station for directing air into the region of the front edge of the delivery stack beneath the sheet hold-up devices for guiding and protecting sheets during removal. In the illustrated embodiment, a plurality of air directing tubes 10 are arranged over the width of delivery unit slightly in front of the front edge of the delivery stack, namely slightly beyond the front edge of the delivery stack in the running direction of the conveyed sheets. The air directing tubes 10 preferably each are supported by and located under the sheet hold-up devices 9 in substantially parallel relation to the sheet hold-up devices. The air directing tubes 10 in this case communicate with a pressurized air source through a coupling 14 in the pressurized air supply line 12 for the sheet hold-up device 9, and pressurized air to the blowing tubes 10 may be controlled by a suitable valve 15 regulated by the control 13. It will be understood that a common source of pressurized air under operation of control 13 can also be used for operating the front lays 8. Alternately pressurized air could be independently supplied to the air directing tubes 10, the sheet hold-up device 9, and the front lays 8. With such inclined mounting of the air direction tubes 10, a pressurized air stream is directed in a downward and rearward direction toward the front edge of the delivery stack tube, and if desired, the tubes may be provided with appropriate nozzles at a discharge end. In such orientation, upon actuation of the pistons 11 of the sheet hold-up device 9, air initially is directed onto the top of the stack and then both on top and under a sample as the sample sheet is removed from the stack.

In operation, upon triggering of a signal by the control 13 for the sample sheet removal, the sheet hold-up devices 9 are activated by directing pressurized air through the inlet line 12. This causes the pistons 11, of the sheet hold-up devices to move into the region of the delivery stack 2, with the result that incoming printed sheets come to be located thereon, as illustrated in FIG. 3. Thereafter, the front lays 8 may be tilted away from the delivery stack, and the printed sheets 6 which run in after this continue to be deposited on the pistons 11 of the sheet hold-up devices 9. At the same time, pressurized air directed through the inlet line 12 for the sheet hold-up devices 9 may be directed through the air directing tubes 9. The air directing tubes 10 direct a pressurized air stream S into the gap between the upper side of the delivery stack 2 and the printed sheets 6 resting on the sheet hold-up device piston rods 11. This forms an air cushion LP1 between the upper side of the stack and the printed sheets 6 which are being held up by the hold-up devices 9. At this time, the uppermost printed sheets 6 on the delivery stack 2 may be removed from the delivery stack as a sample sheet P, as illustrated in FIG. 3.

Figure 4:
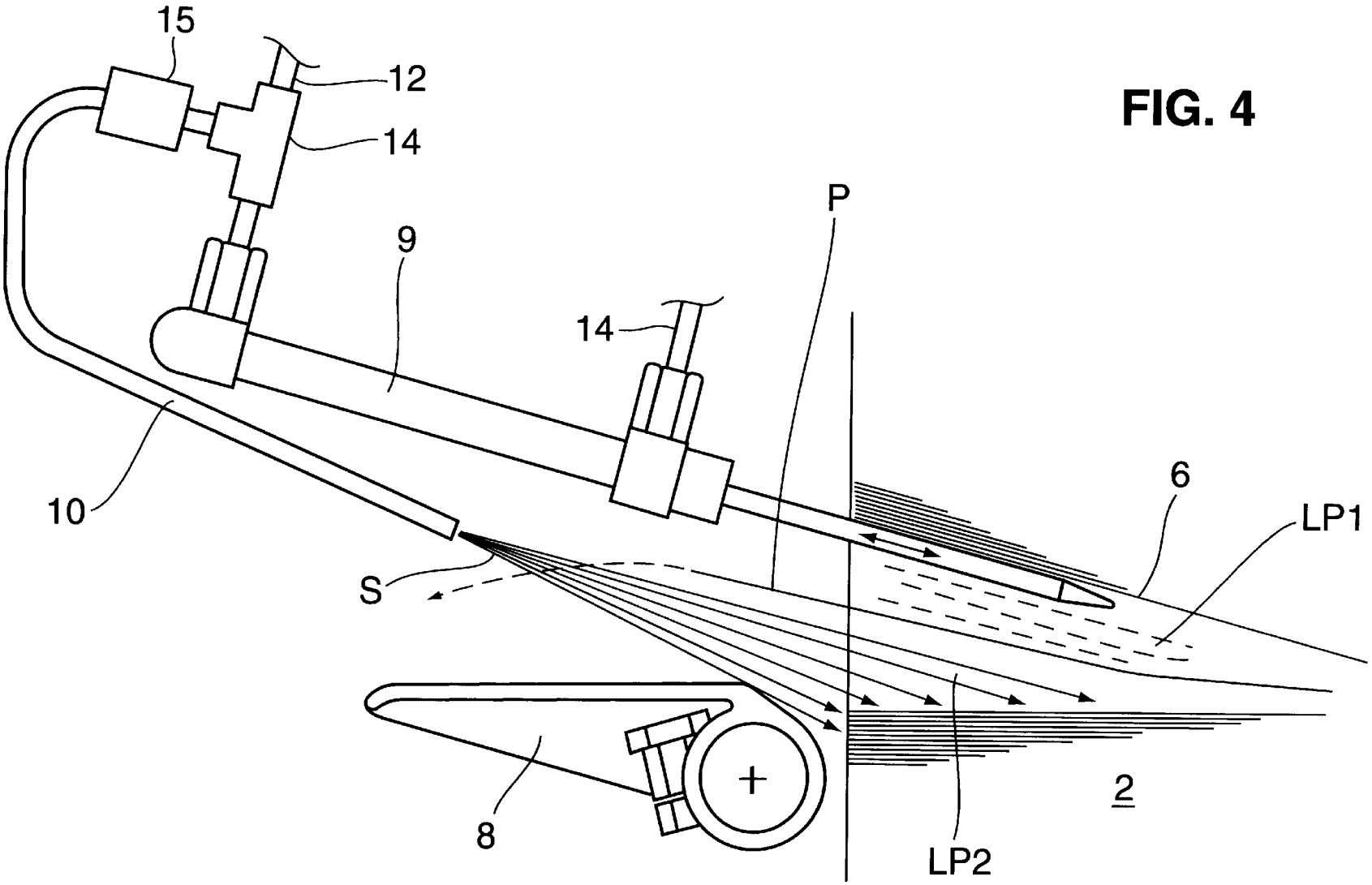
FIG. 4 is a side elevational view, similar to FIG. 3, showing a sample sheet being removed from the stack.

By virtue of the front edge of the sample sheet P being raised as it is being removed from the delivery stack, as illustrated in FIG. 4, the blowing air stream S is then directed to the region above the sample sheet P, as well as to the region below the sample sheet P and towards the upper edge of the deliver stack 2. As a result, an air cushion LP2 forms between the sample sheet P and the upper side of the delivery stack 2.

Since an air cushion LP1 is present above the sample sheet P and the air cushion LP2 is present below the sample sheet P, the sheet can easily be drawn out, without adhering to the adjacent printed sheet 6 of the delivery stack 2 or sheets on the sheet hold-up devices 9 which continues to receive the successive printed sheets from the chain conveyor. The known difficulties caused by adjacent sheets adhering to each other during the sample sheet removal are thereby eliminated.

Since the air supply necessary for the air cushion LP1, LP2 can be automatically controlled, the sample sheet removal operation can be simplified and carried out in a cost effective manner. As the sample sheet is nearly completely removed from the stack, the auxiliary blowing air stream S is directed onto the sample sheet again, so that at this critical point, the air again is directed toward the held up printed sheet 6 and provides good guidance with the trailing end of the sheet being removed from the stack.

Upon completion of the sample sheet removal, the front lays 8 again may be swung to their upright position against the delivery stack 2. Slightly offset in timed relation with respect to that operation, the piston rods 11 are retracted, with the result that the held up printed sheet 6 drop onto the delivery stack 2. At the same time, the blowing air stream S from the air directing tubes 10 is terminated.

Hence, it can be seen that while the air directing tubes 10 may be arranged as required with respect to the upper edge of the stack, preferably, during the sample sheet removal operation, the blowing air stream S should be directed onto the upper side of the sample sheet P first of all, and then the air is blown beneath the sample sheet P for a short period of time, and finally, the blowing air is directed onto the upper side again. Moreover, the air directing tubes 10, should, of course, not form an obstruction when the sample sheet P is being drawn out.

From the foregoing, it can be seen that the sheet hold-up device and the air directing tubes enable relatively simple and reliable removal of sample sheets from the stack at the delivery station of a printing press. The devices also can be readily incorporated into a delivery station and enable sample sheets, even with relatively large printed surface areas, to be removed from the stack without damage.

What is claimed is:

1. In a printing press having a sheet conveyor for delivering sheets to a delivery station, said delivery station comprising front lays against which printed sheets conveyed to said delivery station are positioned in a delivery stack, said front lays defining a front edge of said delivery stack in a running direction, a sheet hold-up device disposed adjacent the front edge of the said stack and being extendable into the region of said delivery stack for receiving and holding up on an upper side thereof printed sheets conveyed to the delivery station for interrupting the stacking of such held up sheets onto the delivery stack, and a pressurized air directing device arranged in front and above of the front edge of said delivery stack beneath said sheet hold-up devices for directing air onto the region of the front edge of the delivery stack at an acute angle to an upper side of said stack.

2. A method of sample sheet removal from a delivery station of a printing press having a conveyor for conveying sheets onto a delivery stack in the delivery station against front lays which are adapted for swinging movement between raised and lowered positions and a sheet hold-up device located at the delivery station and being extendable into the region of said delivery stack for receiving printed sheets being conveyed to the delivery station and for interrupting the stacking of such sheets onto the delivery stack comprising the steps of extending the sheet hold-up device into the region of the delivery stack for holding up some printed sheets being conveyed to the delivery stack, swinging the front lays to their lowered position to release and make accessible a top portion of the delivery stack, blowing a pressurized air stream downwardly at an acute angle to an upper side of said stack in the region between the sheet hold-up device and the upper side of the delivery stack such that before a sample sheet is drawn out and removed the blowing air stream forms an air cushion above the sample sheet and as the sample sheet is raised during removal of the stack delivery the blowing air stream is directed beneath the sample sheet and forms an air cushion between the underside of the sample sheet and the top of the remaining delivery stack.

3. In a printing press having a sheet conveyor for delivering sheets to a delivery station, said delivery station comprising front lays against which printed sheets conveyed to said delivery station are positioned in a delivery stack, said front lays defining a front edge of said delivery stack in a running direction, a sheet hold-up device disposed adjacent the front edge of the said stack and being extendable into the region of said delivery stack for receiving and holding up on an upper side thereof printed sheets conveyed to the delivery station for interrupting the stacking of such held up sheets onto the delivery stack, and a pressurized air directing device including at least one blowing tube arranged in front of the front edge of said delivery stack beneath said sheet hold-up devices for directing air onto the region of the front edge of the delivery stack.

4. In a printing press having a sheet conveyor for delivering sheets to a delivery station, said delivery station comprising front lays against which printed sheets conveyed to said delivery station are positioned in a delivery stack, said front lays defining a front edge of said delivery stack in a running direction, a sheet hold-up device disposed adjacent the front edge of the said stack having a pneumatic cylinder with an air actuated extendable and retractable rod that is extendable into the region of said delivery stack for receiving and holding up an upper side thereof printed sheets conveyed to the delivery station for interrupting the stacking of such held up sheets onto the delivery stack, and a pressurized air directing device arranged in front of the front edge of said delivery stack beneath said sheet hold-up devices for directing air onto the region of the front edge of the delivery stack.

5. In the printing press of claim 4 in which said pneumatic cylinder is coupled to the same air supply source as said pressurized air directing device.

6. In the printing press of claim 4 in which said front lays are pivotable between a raised operating position and a lowered position for enabling withdrawal of a sample sheet from the delivery stack.

7. In the printing press of claim 6 in which said front lays are air actuated, being coupled to the same pressurized air source as said sheet hold-up device and said pressurized air directing device.

8. In a printing press having a sheet conveyor for delivering sheets to a delivery station, said delivery station comprising front lays against which printed sheets conveyed to said delivery station are positioned in a delivery stack, said front lays defining a front edge of said delivery stack in a running direction, a sheet hold-up device disposed adjacent the front edge of the said stack and being extendable into the region of said delivery stack for receiving and holding up on an upper side thereof printed sheets conveyed to the delivery station for interrupting the stacking of such held up sheets onto the delivery stack, and a pressurized air directing device including an elongated tube supported by said sheet hold-up device in front of the front edge of said delivery stack beneath said sheet hold-up devices for directing air onto the region of the front edge of the delivery stack.

9. In the printing press of claim 8 in which said tube is disposed below said sheet hold-up device and is approximately parallel thereto.

10. In the printing press of claim 8 in which said tube is inclined to the horizontal for directing an air stream in a downward and rearward direction relative to the front edge of the delivery stack.

* * * * *